US005193918A

United States Patent [19]

Lohrmann et al.

[11] Patent Number: 5,193,918

[45] Date of Patent: Mar. 16, 1993

[54] PRINT-HEAD POSITIONING SYSTEM HAVING A PAPER SENSOR

[75] Inventors: Gerhard Lohrmann, Elchingen/Thalfingen; Helmut Riesenegger, Elchingen, both of Fed. Rep. of Germany

[73] Assignee: Mannesmann Aktiengesellschaft, Düsseldorf, Fed. Rep. of Germany

[21] Appl. No.: 404,893

[22] Filed: Sep. 8, 1989

[30] Foreign Application Priority Data

Sep. 8, 1988 [DE] Fed. Rep. of Germany ..... 3830880

[51] Int. Cl.[5] ..... B41J 25/308

[52] U.S. Cl. ..... 400/56; 400/57

[58] Field of Search ..... 400/55-59, 400/352, 354; 101/93.03

[56] References Cited

U.S. PATENT DOCUMENTS

| | | | |
|---|---|---|---|
| 4,233,895 | 11/1980 | Wehler | 400/57 |
| 4,420,269 | 12/1983 | Ackermann et al. | 400/59 |
| 4,611,698 | 9/1986 | Lehmann | 192/87.14 |
| 4,676,675 | 6/1987 | Suzuki et al. | 400/56 |
| 4,847,638 | 7/1989 | Moriyama | 400/56 |
| 4,883,375 | 11/1989 | Karube et al. | 400/55 |
| 4,917,512 | 4/1990 | Mimura et al. | 400/56 |

FOREIGN PATENT DOCUMENTS

| | | | |
|---|---|---|---|
| 39978 | 3/1982 | Japan | 400/57 |
| 96868 | 6/1982 | Japan | 400/56 |
| 212373 | 10/1985 | Japan | 400/56 |
| 60-240483 | 11/1985 | Japan . | |
| 171377 | 8/1986 | Japan | 400/56 |
| 74676 | 4/1987 | Japan | 400/56 |
| 119077 | 5/1987 | Japan | 400/56 |

*Primary Examiner*—Edgar S. Burr
*Assistant Examiner*—John S. Hilten
*Attorney, Agent, or Firm*—Horst M. Kasper

[57] ABSTRACT

A printer with a print-head distance-setting device for adjusting the distance (1) between print head (2) and print-material counter support (3) for recording-material carriers (4) of unequal thickness, resting on the print-material counter support (3), including a mechanical sensing member (5) for controlling a print head (2), adjustable in a direction perpendicular relative to the longitudinal direction of the slider carriage motion, where the print head (2) is disposed on a longitudinally movable print-head slider carriage (7), which print-head slider carriage (7) in turn is guided with a pair of parallel guide axles (9), of which one guide axle (9) is supported by way of a pair of eccentric-disposed pins (10) and of which the second guide axle (9) is cross-movably supported in the printer side walls (32). In order to achieve a simpler and more easily constructed print-head distance-setting device, which can in addition be controlled more accurately, an electrical analog signal, generatable by the setting motions of the sensing member (5), serves in a converted configuration of an electronic digital signal in an electronic circuit (11) for the control of a step motor (12), supported at a printer frame, where the step motor (12) forms a servo drive (13) for the pair of eccentric-disposed pins (10) of the guide axle (9).

21 Claims, 1 Drawing Sheet

PRINT-HEAD POSITIONING SYSTEM HAVING A PAPER SENSOR

BACKGROUND OF THE INVENTION

1. Field of the Invention

The invention relates to a printer, and in particular to a matrix pin printer, with a print-head distance setting device for setting the distance between the print head and the print-material counter support for recording materials of unequal thickness or for a varying number of recording-ink carriers, resting on the print counter support, where a mechanical sensing member rests on the recording carrier or carriers, where the mechanical sensing member serves for controlling a print-head position adjustable in a cross direction relative to the longitudinal direction of a print-head carriage motion.

2. Brief Description of the Background of the Invention Including Prior Art

Print-head distance-setting devices are required because of a small stroke path of print elements such as, for example, of print pins, where the stroke amounts to about 0.3 to 0.5 mm. The character image, generated by the print head, is substantially determined by a properly set distance between the print head and the print-material counter support.

A device for adjusting and setting the distance of a print head perpendicular to the print-material counter support is known from the German Patent DE-C1, 2,752,061. Said device serves for an adjustable, automatic distance control of the print head versus the recording-material carrier, depending on different thicknesses and numbers of layers of the recording-material carrier resting on the print-material counter support. The print head is slidable on a transport slider carriage, movable in parallel to the print-material counter support, with an eccentrically disposed pin drivable by an electric motor. The electric motor is controlled by a mechanical-electrical converter. Said mechanical-electrical converter in turn can be influenced by the different strengths and thicknesses of the recording-material carriers resting on the print-material counter support.

This arrangement of the distance-setting device on the print-head slider carriage is not only expensive and therefore uneconomical, but it increases in addition the driving weight of the print-head slider carriage. In addition, the accuracy of the distance-setting device depends on the precision of the electric motor, which electric motor is carried along on the slider carriage.

SUMMARY OF THE INVENTION

1. Purposes of the Invention

It is an object of the present invention to provide a simpler print-head distance-setting device for a printer, in particular a matrix printer.

It is another object of the present invention to provide a print-head distance-setting mechanism for a printer which does not increase the weight of the slider mass to be moved from one position to a second position.

It is yet a further object of the present invention to provide a print-head distance-setting device which is controllable with precision.

These and other objects and advantages of the present invention will become evident from the description which follows.

2. Brief Description of the Invention

The present invention provides for a printer with a print-head distance-setting device comprising a printer frame having side walls and a print head. A print-material counter support for a recording-material carrier selected from recording-material carriers of varying thickness, or for a changing number of superposed recording-material carriers, forms a recording-material carrier surface disposed toward the print head. A mechanical sensing member rests on the recording-material carrier surface. A first guide axle is disposed parallel to a second guide axle. A longitudinally movable print-head slider carriage supports the print head. Said print-head slider carriage is guided on the first guide axle and on the second guide axle. A pair of eccentrically disposed pins are disposed at the two ends of the first guide axle and disposed eccentrically relative to the axis of the first guide axle of supporting the first guide axle. A second guide axle is supported movable in a direction perpendicular relative to an axis of the second guide axle in the printer side walls. A step motor is supported in the printer frame. The step motor serves as a servo drive for pivoting the pair of eccentrically disposed pins of the guide axle for adjusting a distance between the print head and the print-material counter support. An electronic circuit processes an electrical analog signal, derived of adjustment motions of the sensing member, to a converted configuration of an electronic digital signal for generating in the electronic circuit an output signal for controlling the step motor. In this way the sensing member serves for controlling the position of the print head, adjustable perpendicular to a longitudinal direction defined by a direction of motion of the movable print-head slider carriage.

The step motor and the mechanical sensing member can be mounted to the printer frame. The pair of eccentrically disposed pins can be pivotably supported on the printer frame.

The electronic circuit can include a sensor. The mechanical sensing member can include a sensing lever having a first end and a second end. A sensing roller can be rotatably supported at the first end of the sensing lever. Spring means can subject the sensing roller to a spring force. An indicator can be disposed at the second end of the sensing lever. A motion of the indicator can generate an analog signal in the sensor of the electronic circuit.

The electronic circuit for processing an analog signal can include a sensor for generating an analog signal derived from the mechanical sensor member. An operational amplifier can be connected to the sensor. An analog/digital converter can be connected to the operational amplifier. A microprocessor can be connected to the analog/digital converter. A driver circuit can be connected to the micoprocessor, where the driver circuit can control the step motor.

A support casing can be disposed in the frame. A sensing lever can support the mechanical sensor member and can be supported at the support casing. A sensor can be engaged by the sensing lever and can be disposed at the support casing and be connected to the electronic circuit. The electronic circuit can be disposed at the support casing. The sensing lever can be a two-arm lever. The second end of the sensing lever can carry a piece of ferromagnetic material as in indicator. The sensor can be a field-plate differential sensor.

A printer casing can be supported at the printer frame. The support casing, indirectly supporting the sensing roller, can form part of a guide profile. Said guide profile can form, together with the print-material counter support, a feed channel for the recording-material carrier.

A toothed gear-wheel segment can be attached on one of the pair of eccentrically disposed pins of the guide axle in a fixed manner preventing mutual pivoting. A motor pinion can be attached to the axle of the step motor and in drive connection with the toothed gear-wheel segment. An intermediate drive can include a gear wheel. The motor pinion, attached to the axle of the step motor, can be in drive connection via the gear wheel of the intermediate drive. The toothed gear-wheel segment can be movable against a stop into a standard position upon switching on of the step motor.

A printer with a print-head distance-setting device comprises a printer frame and a print head. A print-material counter support for a recording-material carrier, selected from recording-material carriers of varying thicknesses, or for a changing number of superposed recording-material carriers, forms a recording-material carrier surface disposed toward the print head. A sensing means engages the recording-material carrier surface. A longitudinally movable print-head slider carriage supports the print head. Said print-head slider carriage is guided on a first guide bar. A pair of eccentrically disposed pins is disposed at the two ends of the guide bar for supporting the guide bar. A servo motor is supported at the printer frame. The servo motor serves as a servo drive for pivoting the pair of eccentrically disposed pins of the guide bar for adjusting a distance between the print head and the print-material counter support. An electronic circuit processes an electrical signal, derived from the sensing means, to an electronic digital signal for generating in the electronic circuit an output signal for controlling the servo motor. In this way, the sensing means serves for controlling the position of the print head adjustable perpendicular to a longitudinal direction defined by a direction of motion of the movable print-head slider carriage.

The printer frame can include side walls. A second guide bar can be disposed in parallel to the first guide bar and can be supported cross-movably relative to an axis of the second guide axle in the printer side walls.

A method for setting the distance of a print-head relative to a platen comprises the following steps. A print-material counter support is furnished for a recording-material carrier selected from recording-material carriers of varying thickness, or for a changing number of superposed recording-material carriers forming a recording-material carrier surface disposed toward a print head. The recording-material carrier surface engages with a sensing means. A longitudinally movable print-head slider carriage, supporting the print head, is moved and guided along the guide bar having a pair of eccentrically disposed pins disposed at the two ends of the guide bar for supporting the guide bar. The pair of eccentrically disposed pins of the guide bar is pivoted for adjusting a distance between the print head and the print-material counter support with a servo motor supported at the printer frame. Said servo motor furnishes a servo drive for rotation of the pair of eccentrically disposed pins. An electrical signal, derived from the sensing means, is processed in an electronic circuit to an electronic digital signal for generating in the electronic circuit an output signal for controlling the servo motor. In this way, the sensing means serves for controlling the position of the print head, adjustable perpendicular to a longitudinal direction defined by a direction of motion of the movable print-head slider carriage.

A second guide bar, disposed in parallel to the first guide bar, is moved perpendicular relative to an axis of the second guide axle in the printer side walls and perpendicular to a surface of the printing material carrier.

According to the invention, a print-head slider or a print-head carriage is guided on a pair of parallel guide axles. The first guide axle is supported by way of a pair of eccentrically disposed pins and the second guide axle is supported, crosswise movable, in the printer side walls. According to the present invention an electrical analog signal, generatable by adjustment motions of a sensing member, serves in converted form of an electronic digital signal in an electronic circuit for the control of a step motor supported at a printer frame. The step motor forms a servo drive and actuating mechanism for a pair of eccentrically disposed pins supporting the first guide axle. Advantageously, the complete print-head slider carriage is cross-adjusted, with the print head fixedly supported on the print-head slider carriage. In contrast to prior art teaching, the step motor is not disposed as a servo drive on the print-head slider carriage. This allows for a simpler construction of the print-head slider carriage since no additional weight is imposed on the print-head slider carriage. As a result, the step motor is controllable in a more precise manner based on the signal generation and signal transfer. The equipment requirements for this purpose are not substantial. However, it is to be noted that it is no longer left to the operator to select a distance for the print head. Consequently, an erroneous operation is excluded.

An advantageous embodiment of the invention comprises that the sensing member is made of a sensing roller, subjected to a spring force, and which sensing roller is rotatably supported at one end of a sensing lever. An indicator is provided at the second end of the sensing lever. Said indicator cooperates with and is associated with a sensor of the electronic circuit for the generation of the analog signal. Such a sensing device can be produced having virtually no sensitivity to interferences.

According to a further advantageous embodiment of the invention, the electronic circuit for the analog signal includes an operational amplifier following to the sensor, an analog/digital converter, a microprocessor, and a driver circuit. The step motor is controllable by way of the said electronic drive circuit. These device elements can be easily disposed within a printed circuit board without requiring a substantial operating space.

The simpler construction results furthermore from the feature that the sensing lever and the sensor are disposed at a support casing, where the electronic circuit is also disposed within the same support casing.

According to a particular further development of the invention where the objective of a correct and full paper resting position, i.e. a bubble-free resting position of the recording-material carrier or carriers or, respectively, an interference-free paper advancing or retracting, is furnished in that the support casing of the sensing roller forms a part of a guide profile, which guide profile, together with a print-material counter support carrier, forms a feed channel for the recording-material carrier.

The transfer of the adjustment-setting motions of the step motor to the pair of eccentrically disposed pins of the first guide axle is further favored in that a motor pinion of the step motor is in drive connection, via toothed gear wheels of an intermediate drive, with a toothed gear-wheel segment. Said toothed gear-wheel segment is attached, fixed against rotation, on the pair of eccentrically disposed pins of the guide axle.

It is further advantageous if the toothed gear-wheel segment, upon switching on of the step motor, is movable against a stop into a base position. In this case, upon each renewed switching-on procedure, the existing paper thickness is scanned and a possibly inaccurate distance setting is corrected.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
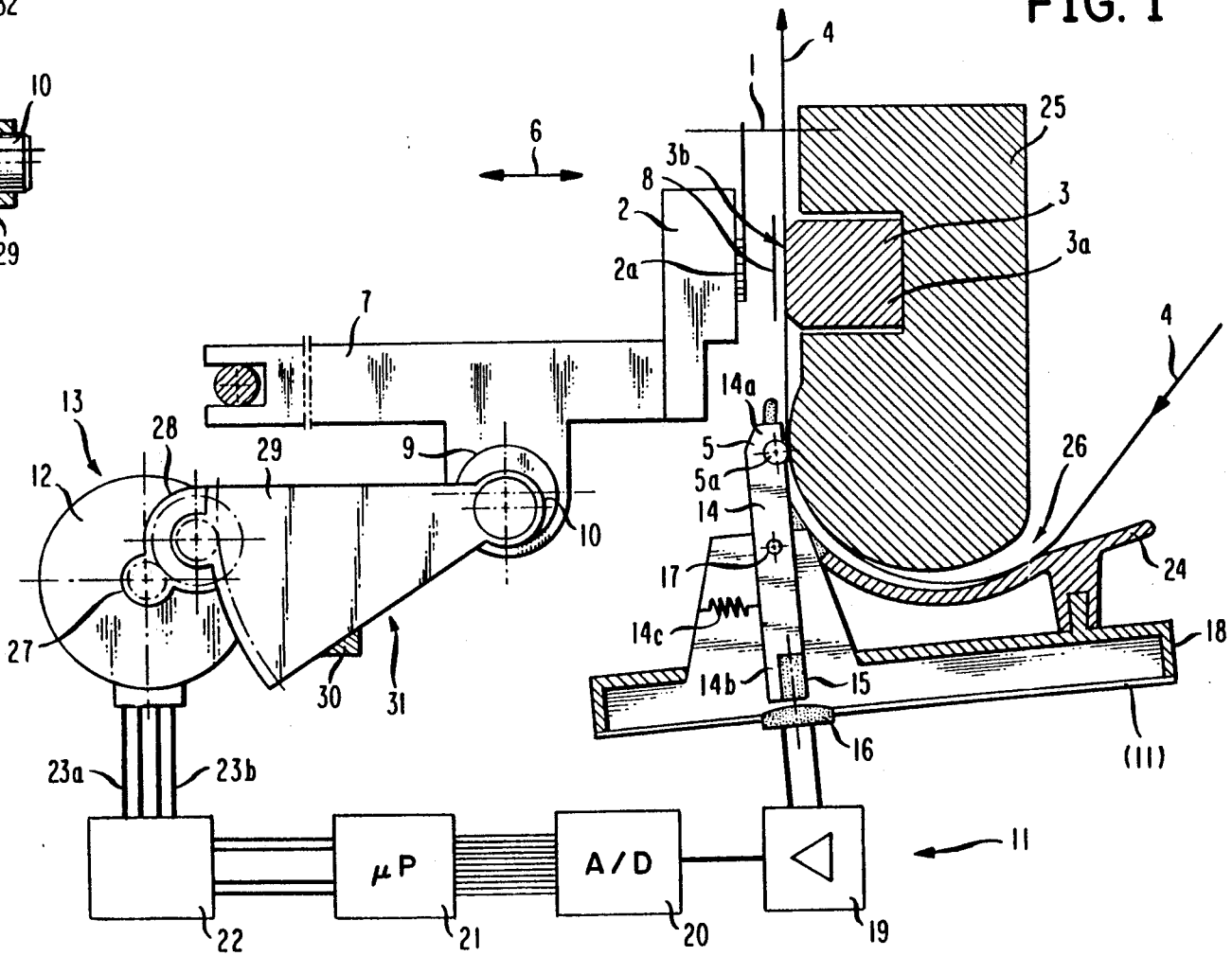
FIG. 1 is a schematic, in part sectional, in part elevational, view of the printer in the area of the print head, including parts concerned with the setting of the print head, in particular the print-material counter support with a print-head slider carriage in connection with a block-circuit diagram for signal input and signal output or, respectively, for signal processing.
Figure 2:
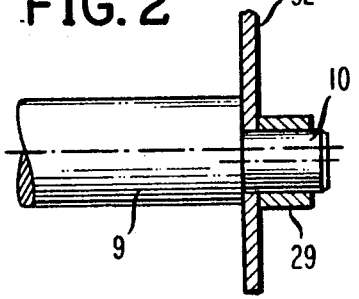
FIG. 2 is an elevational side view of a detail of the pair of eccentrically disposed pins.

In accordance with the present invention, there is provided a printer with a print-head distance-setting device for adjusting a distance 1 between a print head 2 and a print-material counter support 3 for recording-material carriers 4 of non-uniform thickness, or for a changing number of superposed recording-material carriers 4. Said recording-material carriers 4 rest on the print-material counter support 3. One mechanical sensing member 5 rests on the recording-material carrier or carriers 4. Said sensing member 5 serves for controlling the position of the print head 2 adjustable perpendicular to a longitudinal direction defined by a longitudinally movable print-head slider carriage 7 supporting the print head 2. Said print-head slider carriage 7 is guided on a pair of parallel guide axles 9. One of said guide axles 9 is supported by way of a pair of eccentrically disposed pins 10 relative to the axis of the guide axle 9. A second guide axle is cross-movably supported in printer side walls 32, for example, by way of pins restrained by a slot. One electrical analog signal, generatable by adjustment motions of the sensing member 5, is employed in a converted configuration of an electronic digital signal in an electronic circuit 11 for the control of a step motor 12. Said step motor 12 is supported in the printer frame. The step motor 12 serves as a servo drive 13 for the pair of eccentrically disposed pins 10 of the guide axle 9.

The sensing member 5 can comprise a sensing roller **5*a*, rotatably supported at one end 14*a* of a sensing lever 14. The sensing roller 5*a* can be subjected to a spring force. An indicator 15 can be furnished at another end 14*b*. Said indicator 15 can cooperate with a sensor 16 of the electronic circuit 11** in the generation of an analog signal.

The electronic circuit 11 for an analog signal is formed of an operational amplifier 19 following to the sensor 16, an analog-digital converter 20 following to the operational amplifier 19, a microprocessor 21 following to the analog-digital converter 20, and a driver circuit 22 following to the microprocessor 21. The step motor 12 can be controlled by way of these elements.

The sensing lever 14 and the sensor 16 can be disposed at a support casing 18. The electronic circuit 11 can also be disposed in the support casing 18.

The support casing 18 for the sensing roller **5*a* can form part of a guide profile 24. Said guide profile 24 can form, together with the print-material counter support 25, a feed channel 26 for the recording-material carrier 4**.

A motor pinion 27 of the step motor 12 can be in drive connection, via gear wheels 28 of an intermediate toothed, with a toothed gear-wheel segment 29. Said drive gear-wheel segment 29 can be attached on the eccentrically disposed pins 10 of the guide axle 9 in a fixed manner preventing mutual pivoting.

Upon switching on of the step motor 12, the toothed gear-wheel segment 29 can be movable against a stop 30 into a base position 31.

The printer can be a matrix pin printer, a thermo-transfer printer, an ink-jet printer, a bubble-jet printer, a page printer, or the like. The printer exhibits a print-head distance-setting device for adjusting the distance 1 between the print head 2 and the print-material counter support 3. The print-material counter support 3 is advantageously formed as a print bar **3*a* with a vertically extended planar face 3*b*. Recording-material carriers 4 rest on the print-material counter support 3. The recording-material carriers 4** can have a single or a multiple paper thickness such as, for example, in case of multiple paper layers, such as copy sets, or in case of different paper thicknesses. In many application cases, different forms are fed to the printer from several bins.

The thickness of the prevailing individual or multitude of recording-material carriers 4 is automatically determined via a sensing member 5. As illustrated, the sensing member 5 comprises a sensing roller **5*a* and serves for controlling of the print head 2 adjustable crosswise to the longitudinal direction, i.e. in cross-direction 6. The print head 2 is attached to a print-head slider carriage 7 movable in longitudinal direction. The print-head slider carriage 7 is moved back and forth by way of a drive, not illustrated, in longitudinal direction as usual in front of the print-material counter support 3, where the print head 2 generates characters or graphics on the recording-material carrier 4 via the print elements 2*a*. In case of matrix pin printers, there is provided for this purpose an ink ribbon 8. The print-head slider carriage 7 is guided on a pair of parallel guide axles 9. One first guide axle 9, illustrated in FIG. 1, is furnished with a pair of eccentrically disposed pins 10, which is formed by eccentrically disposed pins with equal-sized arms. Each of the toothed gear-wheel segments 29, is, rotatably supported in the printer side walls 32 and forms an arm of the pair of eccentrically disposed pins 10. The eccentric positioning is advantageous as it minimizes a rotary component of the print head, as seen by the print-material counter support 3, and enhances a motion toward and away from the print-material counter support 3. The second guide axle guides and restrains the print-head slider carriage 7** in a vertical direction, however, not in a horizontal direction.

Upon motion of the sensing member 5 in the two pivoting directions, there now results an electrically-generated analog signal. After amplification and conversion into a digital signal in an electronic circuit 11, said analog signal serves for the control of a step motor 12. The step motor 12 is spatially fixedly supported at the printer frame. The step motor 12 forms a servo drive 13 for the pair of eccentrically disposed pins 10 of the guide axle 9.

The mechanical part of the print-head distance-setting device, i.e. the sensing member 5 supports the sensing roller 5*a*, rotatably disposed at one end 14*a* of a sensing lever 14, and, at the other end 14*b*, there is furnished an indicator 15 which cooperates with a sensor 16 of the electronic circuit 11 for the generation of an analog signal. The sensing lever 14, which is preferably a two-arm lever, is rotatably supported around a horizontal axis 17 in a support casing 18 and is pulled with its respective end against the recording-material carrier or carriers 4 by way of a tension spring 14*c*. The support casing 18 receives also the electronic circuit 11. The sensor 16 comprises a field-plate differential sensor, and the indicator 15 is formed of a soft iron material.

The sensing lever 14 is preferably supported within the center fifth of the length of the sensing lever on a horizontal axis 17. Preferably, the lever is attached at its end remote relative to the print head with a spring pressing the sensor against the recording-material carrier 4. The position of the sensing roller 5*a* preferably opposes a rounded curved surface having an oppositely directed radius of curvature, where the radius of curvature is from about 10 to 50, and preferably from about 20 to 30 times the radius of the sensing member. The rounded curved surface provides the advantage that the recording-material carrier 4 is easily pressed against the rounded surface by being pulled along and that no fluttering occurs of the recording-material carrier 4 in the area of the rounded curved surface, such that an accurate thickness measurement and/or accurate thickness sensing can be achieved.

Preferably, the horizontal axis 17, supporting the sensing lever 14, is fixedly attached to the guide profile 24 which constrains the motion of the recording-material carrier 4 to be fed under the print head.

The electronic circuit 11, disposed in the support casting 18, is connected to the sensor 16, which generates an analog signal. An operational amplifier 19 follows to the sensor 16. An analog/digital converter 20 follows to the operational amplifier 19. A microprocessor 21 follows to the analog/digital converter 20. A driver circuit 22 follows to the microprocessor 21. The digitalized signal of the driver circuit 22 controls the step motor 12. The driver circuit 22 is connected, via corresponding control lines 23*a* and 23*b*, to the step motor 12.

The amplifier 19, the analog/digital converter 20, the microprocessor 21, and the driver circuit element 22 can be substituted by any servo-circuit which is sensitive to an electrical signal and which provides a mechanical motion.

The support casing 18 forms at the same time a part of a guide profile 24, which forms, together with the print-material counter-support carrier 25, a feed channel 26 for the recording-material carrier or carriers 4.

A motor pinion 27 on the shaft of the step motor 12 drives a toothed gear-wheel segment 29 via a gear wheel 28 of an intermediate drive. The toothed gear-wheel segment 29 is attached, fixed against rotation, on the pair of eccentrically disposed pins 10 of the guide axle 9. Upon turning on of the printer and/or of the step motor 12, the toothed gear-wheel segment 29 is movable against a stop 30 into the illustrated base position 31. The first guide axle 9 performs a cam-like motion upon turning of the toothed gear-wheel segment 29. However, the guide axle can have shapes other than a rod, such as a bar or an I-beam, where the position of pin 10 would not be eccentric, but instead similarly asymmetric relative to the symmetry axis of the bar or I-beam.

The guide axle 9, supported in the printer side walls 32, is positioned adjustable by way of pivoting of its pair of eccentrically disposed pins 10, whereby the distance 1 between the print head 2 and the print-material counter support 3 is adjustable. Upon motion of the toothed gear-wheel segment 29, which is fixed against rotation and connected with the pair of eccentrically disposed pins 10, the guide axle 9 is adjusted and therewith the position of the print-head slider carriage 7, and thus of the print head 2, such that the distance 1 is changed. It is not necessary to furnish each member of the pair of eccentrically disposed pins 10 with a toothed gear-wheel segment 29.

In addition to pivoting the pair of eccentrically disposed pins 10 of the print-head slider carriage 7, it is also possible to drive a support which would in turn support the guide axle 9 for the print-head slider carriage 7.

It will be understood that each of the elements described above, or two or more together, may also find a useful application in other types of sheet and form processing systems differing from the types described above.

While the invention has been illustrated and described as embodied in the context of a printer with print head positioning system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A printer with a print-head distance-setting device comprising a printer frame having side walls;

a print head;

a print-material counter support for a recording-material carrier selected from recording-material carriers of varying thicknesses, or for a changing number of superposed recording-material carriers forming a recording-material carrier surface disposed toward the print head;

a mechanical sensing member resting on the recording-material carrier surface;

a first guide axle; said first guide axle having two ends and a axis, a second guide axle disposed parallel to the first guide axle; a sensing member;

a longitudinally movable print-head slider carriage supporting the print head, which print-head slider carriage is guided on the first guide axle and on the second guide axle;

a pair of eccentrically disposed pins disposed at the two ends of the first guide axle and disposed eccentrically relative to the axis of the first guide axle for supporting the first guide axle;

wherein the second guide axle is supported movably in a direction perpendicular relative to an axis of the second guide axle in the printer side walls;

a step motor supported in the printer frame, wherein the step motor is a servo drive having means for pivoting the pair of eccentrically disposed pins of the guid axle and for adjusting a distance between the print head and the print-material counter support;

an electronic circuit having means for processing an electrical analog signal, derived from adjustment motions of the sensing member, to a converted configuration of an electronic digital signal for generating in the electronic circuit an output signal for controlling the step motor, such that the sensing member controls the position of the print head;

means for adjusting the print-head perpendicular to a longitudinal direction defined by a direction of motion of the movable print-head slider carriage;

wherein the electronic circuit includes a sensor and wherein the mechanical sensing member includes a sensing lever having a first end, a second end and a pivot between the first end and the second end;

a sensing roller rotatably supported at the first end of the sensing lever;

spring means for subjecting the sensing roller to a spring force;

an indicator of soft iron material disposed at the second end of the sensing lever;

means for generating an analog signal in the sensor of the electronic circuit based on the motion of the indicator.

2. The printer according to claim 1, wherein the step motor is mounted to the printer frame; and wherein the mechanical sensing member is mounted to be printer frame.

3. The printer according to claim 1, wherein the pair of eccentrically disposed pins is pivotably supported on the printer frame.

4. The printer according to claim 1, wherein the electronic circuit for processing an analog signal includes a sensor for generating an analog signal derived from the mechanical sensor member; and further comprising an operational amplifier connected to the sensor;

an analog/digital converter connected to the operational amplifier;

a microprocessor connected to the analog/digital converter; and a driver circuit connected to the microprocessor, wherein the driver circuit controls the step motor.

5. The printer according to claim 1 further comprising a printer casing supported at the printer frame, wherein the support casing, indirectly supporting a sensing roller, forms part of a guide profile, which guide profile forms, together with the print-material counter support, a feed channel for the recording-material carrier.

6. The printer according to claim 1, further comprising a support casing disposed in the frame;

a sensing lever supporting the mechanical sensing member and supported at the support casing;

a sensor engaged by the sensing lever and disposed at the support casing and connected to the electronic circuit, wherein the electronic circuit is disposed at the support casing.

7. The printer according to claim 6, wherein the sensing lever is a two-arm lever; and wherein the second end of the sensing lever carries a piece of ferromagnetic material as an indicator.

8. The printer according to claim 6, wherein the sensor is a field-plate differential sensor.

9. The printer according to claim 1, further comprising a toothed gear-wheel segment attached on the pair of eccentrically disposed pins of the guide axle in a fixed manner preventing mutual pivoting;

a motor pinion attached to the axle of the step motor and in drive connection with the toothed gear-wheel segment.

10. The printer according to claim 9, further comprising an intermediate drive including a gear wheel, wherein the motor pinion attached to the axle of the step motor is in drive connection via the gear wheel of the intermediate drive.

11. The printer according to claim 9 further comprising a stop, wherein the toothed gear-wheel segment is movable against the stop into a standard position upon switching on of the step motor.

12. A printer with a print-head distance-setting device comprising a printer frame;

a print head;

a print-material counter support for a recording-material carrier selected from recording-material carriers of varying thicknesses, or for a changing number of superposed recording-material carriers forming a recording-material carrier surface disposed toward the print head;

a sensing means engaging the recording-material carrier surface;

a first guide bar having two ends;

a longitudinally movable print-head slider carriage supporting the print head, which print-head slider carriage is guided on the guide bar;

a pair of eccentrically disposed pins disposed at the two ends of the guide bar for supporting the guide bar;

a servo motor supported at the printer frame, wherein the servo motor is a servo drive having means for pivoting the pair of eccentrically disposed pins of the guide bar for adjusting a distance between the print head and the print-material counter support;

an electronic circuit having means for processing an electrical signal, derived from the sensing means, to an electronic digital signal for generating in the electronic circuit an output signal for controlling the servo motor;

means for adjusting the print head perpendicular to a longitudinal direction defined by a direction of motion of the movable print-head slider carriage, such that the sensing means serves for controlling the position of the print head adjustable perpendicular to said longitudinal direction;

wherein the electronic circuit includes a sensor and wherein the mechanical sensing member includes a sensing lever having a first end, a second end and a pivot between the first end and the second end;

a sensing roller rotatably supported at the first end of the sensing lever;

spring means for subjecting the sensing roller to a spring force;

an indicator of soft iron material disposed at the second end of the sensing lever;

means for generating an analog signal in the sensor of the electronic circuit based on the motion of the indicator.

13. The printer according to claim 12, wherein the printer frame includes side walls; and further comprising a second guide bar disposed in parallel to the first guide bar and supported relative to an axis of a guide axle in the printer side walls.

14. A printer with a print-head distance-setting device for adjusting a distance between a print head and a print-material counter support for recording-material carriers of nonuniform thickness, or for a changing number of superposed recording-material carriers, resting on the print-material counter support comprising a recording material carrier;

a pair of eccentrically disposed pins (10);

a longitudinally movable print-head slider carriage (7), which print-head slider carriage (7) is guided on a pair of parallel guide axles (9, 99), of which one guide axle (9) is supported by way of the pair of eccentrically disposed pins (10);

printer side walls (32);

a second guide axle (99) cross-movably supported in the printer side walls (32);

a print head (2) adjustable perpendicular to a longitudinal direction defined by the longitudinally movable print-head slider carriage (7);

a mechanical sensing member (5), resting on the recording-material carrier (4), which sensing member (5) having means for controlling the position of the print head (2) and is adjustable perpendicular to a longitudinal direction defined by the longitudinally movable print-head slider carriage (7) supporting the print head (2);

an electronic circuit (11), having means to provide a electrical analog signal, generated by adjustment motions of the sensing member (5), is converted into an electronic digital signal in an electronic circuit (11) and having means for the control of a step motor (12), supported in the printer frame, wherein the step motor (12) is a servo drive (13) for the pair of eccentrically disposed pins (10) of the guide axle (9);

wherein the electronic circuit includes a sensor and wherein the mechanical sensing member includes a sensing lever having a first end, a second end and a pivot between the first end and the second end;

a sensing roller rotatably supported at the first end of the sensing lever;

spring means for subjecting the sensing roller to a spring force;

an indicator of soft iron material disposed at the second end of the sensing lever;

means for generating an analog signal in the sensor of the electronic circuit based on the motion of the indicator.

15. The printer according to claim 14, wherein the support casing (18) for the sensing roller (5a) forms part of a guide profile (24), which guide profile (24) forms, together with the print-material counter support (25), a feed channel (26) for the recording-material carrier (4).

16. The printer according to claim 14, wherein the electronic circuit (11) for an analog signal is formed of an operation amplifier (19) following to the sensor (16), an analog/digital converter (20) connected sequentially following to the operational amplifier (19), a microprocessor (21) following to the analog/digital converter (20), and a driver circuit (22) following to the microprocessor (21), by way of which elements the step motor (12) is controlled.

17. The printer according to claim 16, further comprising a support casing (18), wherein the sensing lever (14) and the sensor (16) are disposed at a suppoort casing (18), where the electronic circuit (11) is also disposed in the support casing (18).

18. The printer according to claim 14, further comprising an intermediate drive;

gear wheels (28) of an intermediate drive, wherein a motor pinion (27) of the step motor (12) is in drive connection, via the gear wheels (28) of the intermediate drive, with a toothed gear-wheel segment (29), which toothed gear-wheel segment (29) is attached on the pair of eccentrically disposed pins (10) of the guide axle (9) in a fixed manner preventing mutual pivoting.

19. The printer according to claim 18, wherein the toothed gear-wheel segment (29) is movable, upon switching on of the step motor (12), against a stop (30) into a base position (31).

20. A method for setting the distance of a print-head relative to a platen comprising furnishing a print-material counter support for a recording-material carrier selected from recording-material carriers of varying thicknesses; or for a changing number of superposed recording-material carriers providing a print head, sensing means and a guide bar; forming a recording-material carrier surface disposed toward said print head; engaging the recording-material carrier surface with said sensing means;

moving and guiding a longitudinally movable print-head slider carriage, supporting the print head, along the guide bar; providing the guide bar with a pair of eccentrically disposed pins disposed at the two ends of the guide bar for supporting the guide bar; pivoting the pair of eccentrically disposed pins of the guide bar for adjusting a distance between the print head and the print-material counter support with a servo motor supported at the printer frame, wherein the servo motor furnishes a servo drive for rotation of the pair of eccentrically disposed pins;

processing an electrical signal derived from the sensing means in an electronic circuit to an electronic digital signal for generating in the electronic circuit an output signal for controlling the servo motor such that the sensing means serves for controlling the position of the print head, wherein the print head is adjustable perpendicular to a longitudinal direction defined by a direction of motion of the movable print-head slider carriage providing the electronic circuit with a sensor;

providing the mechanical sensing member with a sensing lever having a first end, a second end and a pivot between the first end and the second end;

a sensing roller rotatably supported at the first end of the sensing lever;

spring means for subjecting the sensing roller to a spring force;

an indicator of soft iron material disposed at the second end of the sensing lever; and a means for generating an analog signal in the sensor of the electronic circuit based on the motion of the indicator.

21. The method for setting the distance according to claim 20 further comprising moving a second guide bar disposed in parallel to the first guide bar perpendicular relative to an axis of the second guide axle in the printer side walls and perpendicular to a surface of the printing material carrier.

* * * * *